United States Patent [19]

Freliech

[11] 4,157,785

[45] Jun. 12, 1979

[54] SAFETY CONNECTION FOR A RETROFIT FLUE DAMPER

[75] Inventor: Robert A. Freliech, Fayetteville, N.Y.

[73] Assignee: Carrier Corporation, Syracuse, N.Y.

[21] Appl. No.: 846,946

[22] Filed: Oct. 31, 1977

[51] Int. Cl.[2] ..... F23N 3/00; G05D 23/00

[52] U.S. Cl. ..... 236/1 G; 29/628; 126/285 B; 339/17 LC; 339/31 R; 431/20

[58] Field of Search ..... 236/1 G; 110/163; 126/285 B; 431/20; 339/17 LC, 31 R, 184 R, 184 L, 184 T, 184 M; 29/628

[56] References Cited

U.S. PATENT DOCUMENTS

| | | | |
|---|---|---|---|
| 2,433,384 | 12/1947 | McLarn | 29/628 X |
| 2,698,140 | 12/1954 | Buehler | 236/1 G |
| 2,935,725 | 5/1960 | Fox | 339/184 M |
| 3,140,908 | 7/1964 | McCutcheon | 339/19 |
| 3,223,137 | 12/1965 | Grahl | 431/69 |
| 3,425,021 | 1/1969 | Fow et al. | 339/17 LC |
| 3,489,985 | 1/1970 | Martin | 339/31 R |
| 3,532,802 | 10/1970 | Spall | 174/68.5 |
| 3,533,045 | 10/1970 | Henschen | 339/17 LC |
| 3,544,003 | 12/1970 | Bissell | 236/11 |
| 3,587,558 | 6/1971 | Raleigh | 126/113 |
| 3,601,522 | 8/1971 | Lynch | 174/68.5 |
| 3,664,414 | 5/1972 | Raleigh | 165/26 |
| 3,728,471 | 4/1973 | Bunkhorn | 174/68.5 |
| 3,780,431 | 12/1973 | Feeney | 29/626 |
| 3,818,280 | 6/1974 | Smith et al. | 339/184 M X |
| 3,898,370 | 8/1975 | Davy et al. | 174/68.5 |
| 4,017,024 | 4/1977 | Grostick et al. | 236/1 G |
| 4,021,187 | 5/1977 | Schulte et al. | 431/20 |
| 4,079,884 | 3/1978 | Sherman | 234/1 G |

*Primary Examiner*—Rodney H. Bonck
*Attorney, Agent, or Firm*—J. Raymond Curtin; Robert P. Hayter

[57] ABSTRACT

Apparatus and a method for assuring safe retrofit installation of a flue damper in a hot air furnace. The flue damper is electrically connected to the original furnace control circuit by engaging a flue damper connector with a portion of a printed circuit board containing part of the furnace control circuit. The physical configuration of the adapter and the printed circuit board require removal of a jumper conductor within the printed circuit board prior to connection of the adapter thereby assuring that the flue damper is correctly installed so that it will be in the open position before the furnace may be ignited.

11 Claims, 5 Drawing Figures

SAFETY CONNECTION FOR A RETROFIT FLUE DAMPER

BACKGROUND OF THE INVENTION

1. Field of the Invention

The present invention relates to furnaces which may be retrofitted with a flue damper. More specifically, the invention relates to the wiring circuits and connections for installing a retrofit flue damper within a furnace.

2. Description of the Prior Art

The energy shortages that have become apparent in the last ten years have spurred society towards reducing the energy consumption of existing furnaces as well as designing more efficient future heating devices. In response to this demand for reducing energy consumption renewed interest has focused on regulating energy losses which occur when flue gases carry residual heat through an exhaust flue away from an enclosure to be heated and when cold outdoor air enters the enclosure through the open exhaust flue. By the installation of a flue damper the flue gas passage can be open when the furnace is producing heat to allow for the escape of flue gases and closed when the furnace is not producing heat, thereby eliminating heat losses through the exhaust flue.

Public utilities, the American Gas Association and Underwriters Laboratories have generally prevented the use of flue dampers in furnaces for various safety reasons. If the flue damper does not open during fuel combustion incomplete burning occurs allowing flue gases to build up and creating the potential for the enclosure to be heated to be filled with quantities of carbon monoxide. Furthermore, if the flue damper is not open during combustion, unburned fuel, such as natural gas may be leaked into the enclosure creating the possibility of explosion and fire.

U.S. Pat. Nos. (3,664,414) issued to Raleigh; (3,587,558) Raleigh; (3,223,137) Grahl and (3,544,003) Bissel all concern furnace circuits but not the adaptation of a retrofit flue damper thereto. Various methods and apparatus are known and disclosed in the following United States Patents for removing a portion of a conductor from a printed circuit board: U.S. Pat. Nos. (3,728,471) Blinkhorn; (3,601,522) Lynch; (3,532,802) Spall; and (3,898,370) Davy. None of these references discloses the use of a removable jumper portion of the printed circuit board for preventing the attachment of an electrical connector prior to the removal of the jumper portion.

Other United States Patents relating to connectors for printed circuit boards include U.S. Pat. Nos. (3,140,908) McCutchon; (3,818,280) Smith et al; (3,780,431) Feeney; (3,533,045) Henschen; and (3,425,021) Fow et al. Again, none of these patent references disclose the removal of a portion of the printed circuit board before the connector can be attached.

SUMMARY OF THE INVENTION

An object of the invention is to connect a flue damper circuit to a furnace control circuit.

Another object of the present invention is to install as a part of an original furnace circuit the necessary electrical connections to later receive a retrofit flue damper.

A further object of the present invention is to assure that upon installation of retrofit flue damper the furnace cannot be fired unless the flue damper is in the open position.

A still further object of the present invention is to provide easy, efficient and fail-safe apparatus for field installation of retrofit flue damper by a homeowner.

A yet further object of the present invention is to have a safe, efficient retrofit flue damper system which will comply with upcoming standards for retrofit applications.

Other objects will be apparent from the description and appended claims to follow.

The preceding objects are achieved according to the preferred embodiment of the invention by providing a printed circuit board as part of the original control circuit of the furnace, said printed circuit board having conductor runs adapted to be connected to the retrofit flue damper circuit, and a jumper conductor electrically connecting a thermostat to a gas regulating valve prior to the retrofit flue damper being installed. The flue damper has a connector for connecting to the printed circuit board which is so constructed that a portion of the printed circuit board must be physically removed before the connector can be engaged with the printed circuit board. Once the jumper portion of the printed circuit board is removed and the damper installed the thermostat may energize the gas valve only if the flue damper is in the open position assuring the appropriate flue gas exhaust when the furnace is ignited.

DESCRIPTION OF THE PREFERRED EMBODIMENT

The embodiment of the invention described below is adapted for use in a residential gas fired hot air furnace, although it is to be understood that the invention has like applicability to other forms of heating devices and especially other forms and sizes of furnaces and boilers whether they be fired by natural gas or some other flue gas producing fuel. In the conventional residential furnace a gas regulator valve is connected to a gas burner for providing fuel and air to a heat exchanger where the mixture is combusted producing heat. The products of combustion, the flue gases, are then discharged from the heat exchanger via a flue gas exhaust conduit. Usually the flue gas exhaust is in the form of a chimney or other outlet means for conducting the flue gases outside the residence where they are exhausted to the ambient air.

A flue damper, as is well-known in the industry, is a device designed to prevent the hot gases within the enclosure and combustion chamber of the furnace from being exhausted out of the furnace to the exhaust flue so that the heat built up within the furnace during operation is not exhausted outside the enclosure during that period when the furnace is not being fired. The flue damper further serves to prevent cold ambient air from entering the enclosure when the furnace is not being operated. The flue damper is usually operated by a motor, solenoid or other electrical device so that upon being energized the device and flue damper are closed and upon deenergization or loss of power the device and flue damper are open allowing the discharge of flue gases.

Figure 5:
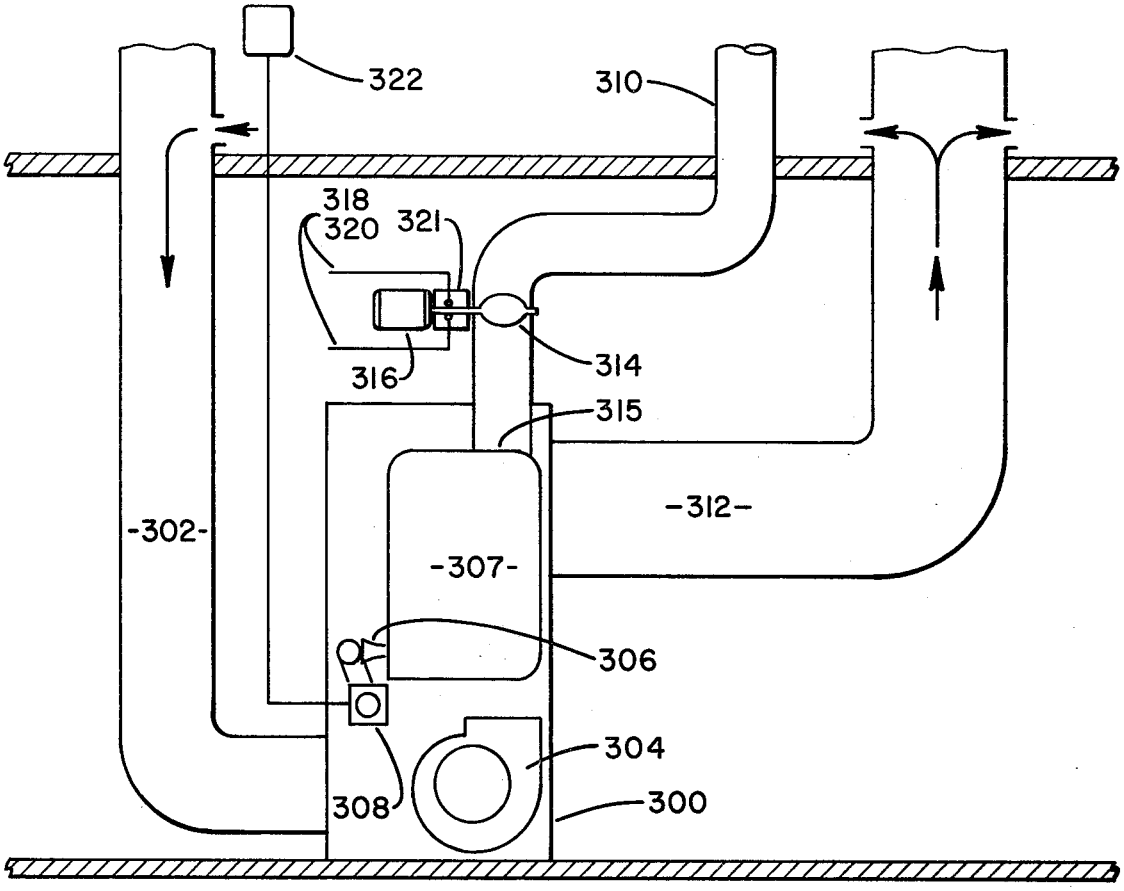
FIG. 5 is a plan view of a furnace with a flue damper.

Referring to the drawings, FIG. 5 is a plan view of furnace 300 having flue damper 314. Cold air is drawn from the enclosure through cold air return 302 to the bottom of furnace 300 by blower 304. This cold air is then passed over the outside surface of heat exchanger 307 absorbing heat in the process. The now heated air is exhausted to the enclosure through hot air plenum 312.

Thermostat 322, mounted in communication with the air of the enclosure activates gas valve 308 when heating is desired. Valve 308 then feeds gas to burner 306. The gas is ignited within heat exchanger 307 such that the products of combustion travel through the heat exchanger to exhaust gas discharge 315. Heat from the products of combustion is absorbed by the air being circulated over the heat exchanger.

The flue gases are then discharged from the enclosure through the flue gas discharge 310. Natural or forced convection allows the heated exhaust to discharge through the flue. Within the flue gas discharge flue damper 314 is pivotally mounted and controlled by flue damper motor 316. Contacts 318 and 320 are mounted on the flue damper control arm within control box 321. When the furnace is not being fired the flue damper closes and contacts 318 and 320 are not engaged to each other. When the furnace is being fired the flue damper is in the open position and contacts 318 and 320 are electrically engaged. In the open position flue gases may readily pass through discharge 310.

Figure 1:
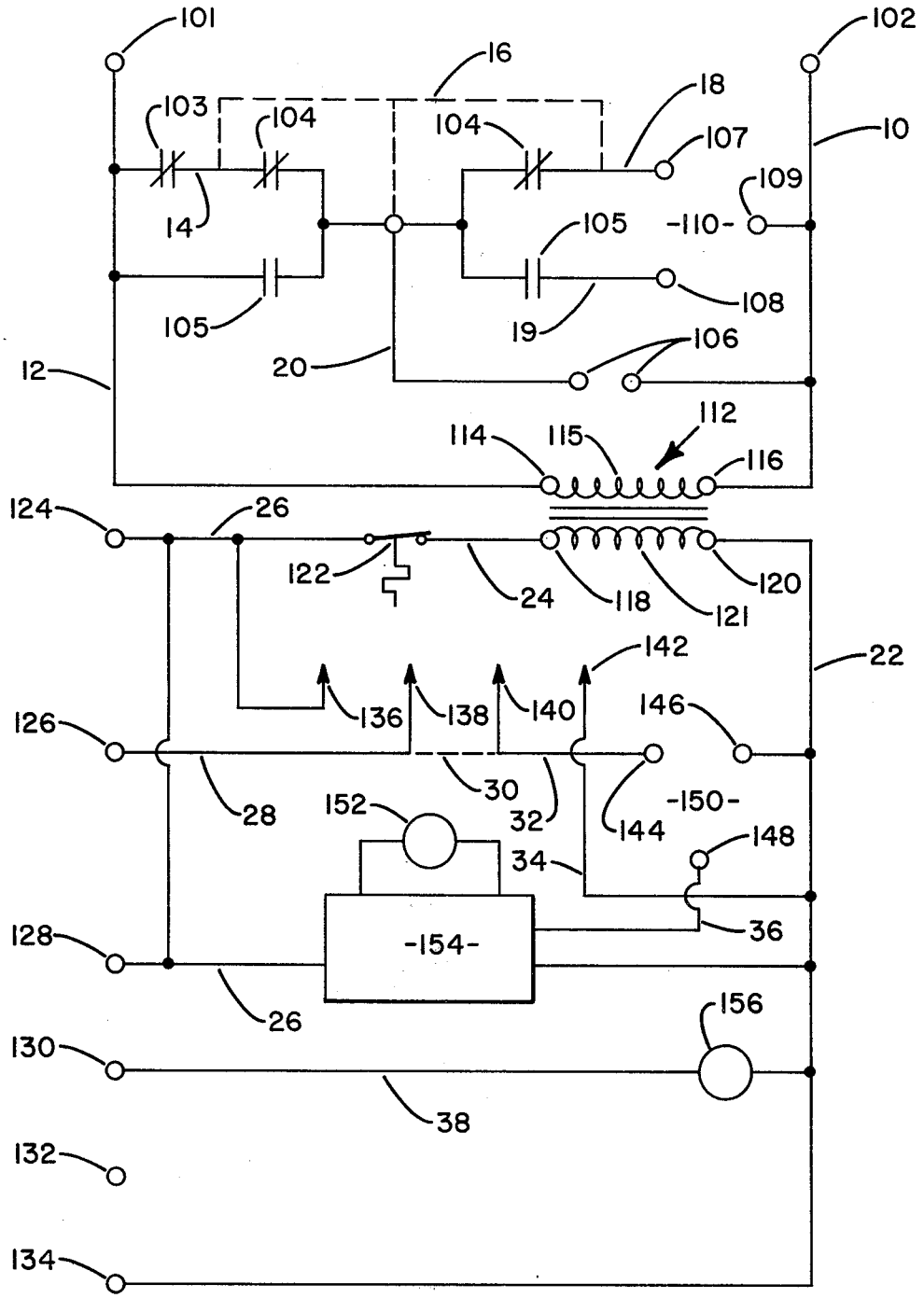
FIG. 1 is a schematic wiring diagram of a printed circuit board to be installed as original furnace equipment.

FIG. 1 shows in schematic form the wiring of a printed circuit board installed as original equipment in the furnace. Therein terminals 101 and 102, line terminals, are connected to an outside power source, such as the electrical power delivered to a typical residence. Terminal 101 is connected by wire 12 to normally closed heating fan relay contacts 103, to normally open cooling fan relay contacts 105 and to terminal 114 of primary winding 115 of transformer 112. Terminal 102 is connected by wire 10 to terminal 109 of the multi-speed fan motor 110, to a terminal of electronic air cleaner 106, and to the primary terminal 116 of transformer 112. Wire 14 connects normally closed heating fan relay contacts 103 to normally closed cooling fan relay contacts 104. Wire 20 connects normally closed relay fan contacts 104, normally open cooling fan relay contacts 105, and one terminal of electronic air cleaner 106. Wire 18 connects normally closed cooling fan relay contacts 104 to the low speed terminal 107 of fan motor 110 and wire 19 connects normally open cooling fan relay contacts 105 to high speed terminal 108 of fan motor 110. Jumper wire 16 is provided to connect normally closed heating fan relay contacts 103 to the low speed terminal 107 of fan motor 110 and to electronic air cleaner terminal 106 such that single speed operation may be controlled with the same printed circuit board. To utilize this printed circuit board with two-speed fan operation a hole is punched in the printed circuit board through wire 16 thereby creating a discontinuity in wire 16 which interrupts the connections made by said wire.

Transformer 112 includes terminals 118 and 120 of secondary winding 121 which is the source of current supply for the control circuit, that portion of the circuit operated at a lower voltage which is typically 24 volts. Terminal 120 is connected by ground wire 22 to gas terminal 146 of gas regulating valve 150, to printed circuit contact 142 adapted to be connected to the flue damper circuit, to time delay relay circuit 154, to cooling fan relay 156, and to common terminal 134. Terminal 118 is connected by wire 24 to over-temperature limit switch 122 which is then connected by wire 26 to terminal 124, to contact 136 adapted to be connected to flue damper circuit, and to time delay relay circuit 154 as well as terminal 128. Terminal 126 is connected by wire 28 to contact 138 adapted to be connected to the flue damper circuit and to jumper conductor 30. Jumper conductor 30 is connected to contact 140 adapted to be connected to the flue damper circuit and to wire 32 which is connected to gas terminal 144 of gas regulator valve 150. Terminal 130 is connected by wire 38 to cooling fan relay 136. Terminal 132 is provided so that air conditioning may later be adapted to this control circuit.

Figure 2:
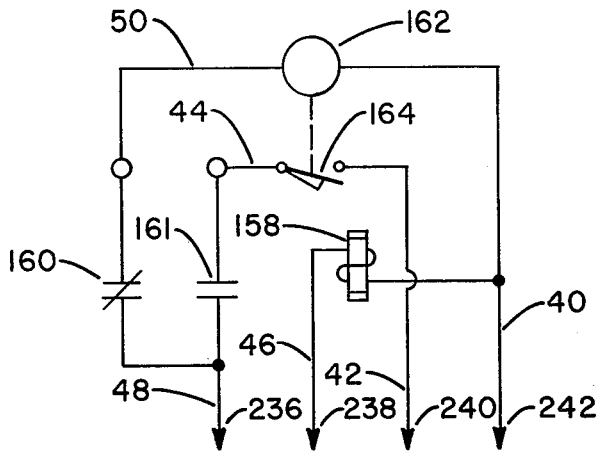
FIG. 2 is a schematic wiring diagram of the retrofit flue damper.

Referring now to FIG. 2, a schematic diagram of the flue damper control circuit, it can be seen thereon that contact 236 adapted to be connected to contact 136 of the furnace control circuit is connected by wire 48 to normally closed damper relay contacts 160 and to normally open damper relay contacts 161. Normally closed damper relay contacts 161 are connected by wire 50 to flue damper motor 162 which in turn is connected by wire 40 to contact 242 adapted to be connected to contact 142 of the furnace control circuit. Normally open damper relay contacts 161 are connected by wire 44 to damper position sensing (shown as a limit switch) contacts 164 which are connected by wire 42 to contact 240 which is adapted to be connected to contact 140 of the furnace control circuit. Damper position sensing contacts 164 are physically mounted so that they are electrically connected only when the flue damper is in the open position. Typically one contact would be located on the damper control shaft and another on the flue structure such that when the flue damper was in the open position the contacts would meet forming an electrical connection. Contact 238 of the flue damper circuit which is adapted to be connected to contact 138 of the furnace control circuit is connected by wire 46 to damper relay coil 158 which is connected to wire 40 and contact 242. Damper relay coil 158 operates damper relay contacts 160 and 161.

OPERATION

During operation of the furnace control circuit power is supplied to terminals 101 and 102, these terminals acting to immediately engage the fan motor 110 since heating fan relay contacts 103 and cooling fan relay contacts 104 are in the normally closed position. However, time delay relay 152 simultaneously actuated through terminals 118 and 120 and the appropriate connecting wires opens heating relay contact 103 such that blower operation is immediately discontinued and remains so until heating is called for. Terminals 124 and 126 are connected to a thermostat, a temperature sensing means, such that power is supplied from terminal 124 to the thermostat and when a heating need is sensed, power is supplied to terminal 126. From terminal 126 power then travels through wire 28, through wire jumper conductor 30 prior to the installation of the retrofit flue damper, and then through wire 32 to gas terminal 144 actuating gas regulator valve 150 and thereby supplying fuel to the burner to commence heating. After when gas terminal 144 is energized, gas terminal 148 and time delay relay circuit 154 are also energized. The time delay relay circuit is so designed that after the expiration of a certain predetermined period the heating fan relay is de-energized so that the blower motor will commence circulating air into the enclosure to be heated. Upon the thermostat sensing an appropriate temperature level power is discontinued to terminal 126 and consequently the time delay relay circuit, said circuit being programmed to continue fan operation for a predetermined time period thereafter. (For a more specific disclosure as to the operation of the normally closed heating fan relay contact 103 and the time delay relay circuit 154 see patent application entitled, "A Furnace Having A Normally Closed Blower Relay", Ser. No. 846,869, filed simultaneously herewith assigned to the assignee hereof.)

When the retrofit flue damper is installed contacts 236, 238, 240 and 242 of the flue damper circuit are respectively connected to contacts 136, 138, 140 and 142 of the furnace control circuit. Prior to this connection, jumper conductor 30 must be removed from the printed circuit board. In order to ignite the furnace after the jumper conductor is removed, the signal from the thermostat must pass to terminal 126, wire 28, contact 138, and to contact 238 which through wire 46 actuates damper relay coil 158 which closes normally open damper relay contacts 161. Once damper relay contacts 161 are in the closed position power is supplied through contact 236, wire 48, damper relay contacts 161, wire 44, damper position sensing contacts 164 if the flue damper is in the open position, then through wire 42, contacts 240 and 140, wire 32, and then to gas relay contact 144 actuating gas regulator valve 150. By rerouting the heat source signal energizing gas regulator valve 150 through damper position sensing contacts 164, a fail-safe method has been provided so that the gas regulator valve cannot be actuated unless the flue damper is in the open position. Should the flue damper vary from the open position the circuit is broken by the separation of damper position sensing contacts 164 preventing further operation of gas regulator valve 150.

When damper relay coil 158 is not energized by a signal from the thermostat normally closed damper relay contacts 160 energize motor 162 through contacts 236, wire 48, normally closed damper relay contacts 160, wire 50, motor 162, wire 40 and contacts 242, said motor maintaining the flue damper in the closed positions.

Figure 3:
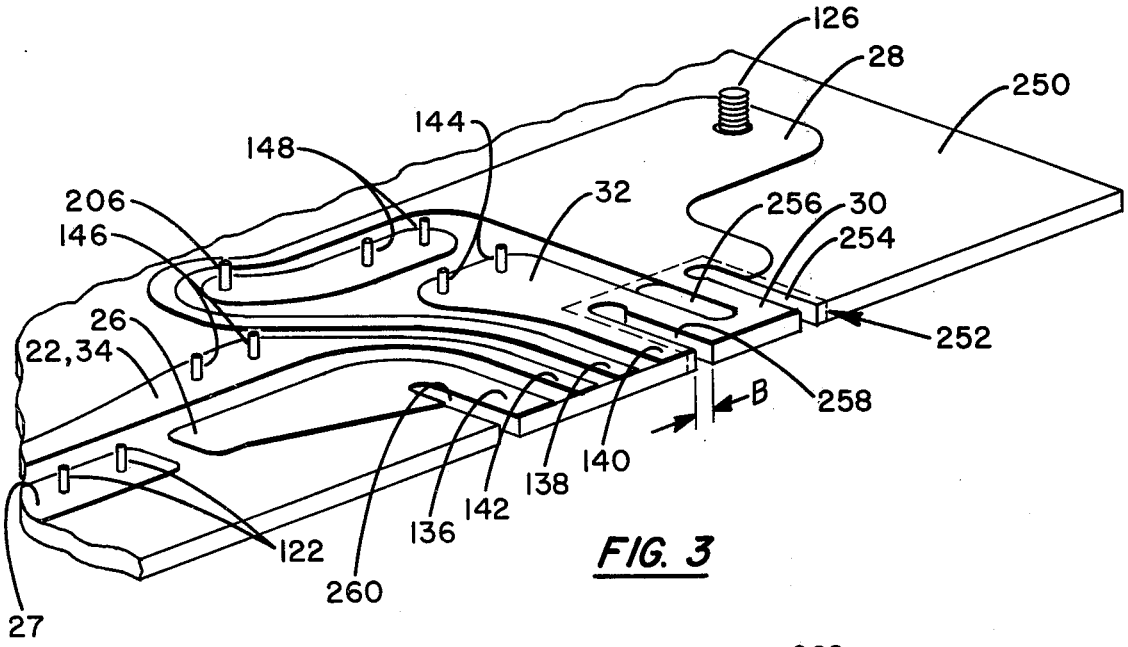
FIG. 3 is a partial perspective view of a cut away portion of the conductor run side of the printed circuit board showing the jumper portion to be removed and the conductor runs to which the connector is connected.

Referring to FIG. 3, a partial cut away view of the conductor side of the printed circuit board, several conductor runs which correspond to the various wires shown in FIG. 1 as part of the furnace control circuit are shown. Terminal 126 is shown connected to conductor 28 which is connected to jumper conductor 30 and conductor 32. Conductors 32, 26 and 22 are also shown thereon. Conductor 28 has a portion thereof connected to jumper conductor 30 and conductor 32 and a portion connected to conductor 32 and a portion connected to conductor 138 which extends to the edge of the printed circuit board. Printed circuit board 250 has several openings therein. Slot 260 extends inward from the edge of the printed circuit board and is sufficiently wide to enable connector 262 (see FIG. 4) to slide therein. Slots 254 and 258 are provided on either side of jumper portion 252 (denoted by the dotted line) containing jumper conductor 30. Additionally opening 256 is shown within jumper portion 252. Between slot 260 and jumper portion 252 are contacts 136, 142, 138 and 140. The contacts 136, 142, 138, and 140 are all shown as the end portion of the conductor runs making up in respective order conductors 26, 22, 28 and 32. Also shown in FIG. 3 are a terminal of over-temperature limit switch 122 mounted in conductor 27, gas terminal 146 mounted in conductor 22, gas terminal 144 mounted in conductor 32, terminal 126 in conductor 28, and gas terminal 148.

Figure 4:
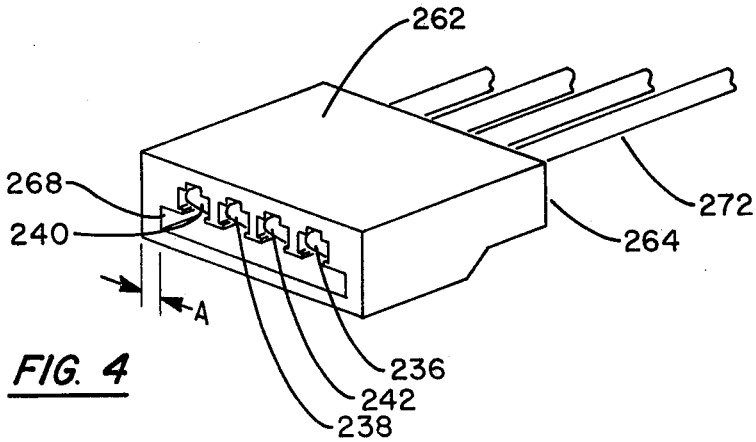
FIG. 4 is a perspective view of the flue damper circuit connector to be connected to the printed circuit board.

FIG. 4 depicts a conventional female connector 262 for installation on the edge of a printed circuit board. Within connector body 264 is opening 268 in which that portion of printed circuit board 250 having contacts 136, 142, 138 and 140 may be inserted. Spring contacts 236, 238, 240 and 242 of connector 262 are so arranged that spring contact 240 engages contact 140 of the printed circuit board, spring contact 238 engages contact 138 of the printed circuit board, spring contact 242 engages contact 142 of the printed circuit board, and spring contact 236 engages contact 136 of the printed circuit board. Each spring contact has attached thereto a wire denoted as wire bundle 272 in FIG. 4, wire bundle 272 being wires 48, 46, 42 and 40 as shown on FIG. 2.

Connector 262 has sufficient width between opening 268 and the outside edge of connector body 264 (denoted as distance A in FIG. 4) that the connector may not be slid over the conductor run portion of the printed circuit board because the width of slot 258 (denoted as distance B in FIG. 3) is less than the width of the connector body with jumper portion 252 in place. Consequently before the connector may be connected, jumper portion 252 must be removed from the printed circuit board. Removal is accomplished by simply gripping jumper portion 252 with a pair of pliers of similar apparatus and bending it so that the printed circuit board snaps at the end of jumper portion 252 or by inserting a screwdriver blade in opening 256 and twisting. This results in a discontinuity between wires 28 and 32. Once jumper portion 252 is removed connector 262 is easily slid over the conductor run portion of printed circuit board 250 such that elecrical contact is made between conductor runs 136, 142, 138 and 140 and the spring contacts 236, 242, 238 and 240 thereby electrically connecting the furnace control circuit with the damper circuit. By removal of the jumper portion 252 the jumper conduit 30 is disconnected assuring that current must flow through the damper position sensing contacts 164 prior to gas regulator valve 150 being powered. Current will only flow through the circuit when the damper position sensing contacts 164 are closed as a result of the flue damper being in the open position. The connector may not be inserted backwards because of the narrow width of slot 260 and the contacts will be on the reverse side of the printed circuit board from the appropriate conductor runs.

A specific embodiment has been disclosed with the physical limitation requiring the removal of the jumper circuit prior to the installation of the retrofit flue damper. It is to be understood that it is within the spirit and scope of this invention to provide other physical limitations requiring the removal of a jumper portion or a jumper circuit before the flue damper circuit may be connected. Furthermore, it is within the scope of this invention to use this invention without a printed circuit board. Any electrical connections may be used with a predetermined mechanical limitation to prevent connection of a flue damper unless a jumper conduit or other means of connecting the thermostat to the gas regulator valve is removed or altered to require current flow through the contacts of the flue damper before the furnace may be ignited.

The invention has been described in detail with particular reference to a preferred embodiment thereof, but it will be understood that variations and modifications can be effected within the spirit and the scope of the invention.

I claim:

1. In a furnace adapted to receive a retrofit flue damper, said furnace having a heat exchanger, heat source means for supplying heat to the heat exchanger, a flow path for flue gases which is adapted to be regulated by a flue damper, a sensing means for determining when heating is required and a retrofit flue damper; an improved flue damper safety arrangement which comprises:

a furnace control circuit being adapted to receive the appropriate connections for the retrofit flue damper, said control circuit including a jumper conductor connecting the sensing means with the heat source means such that when heat is required the heat source means is energized through the jumper conductor;

a flue damper circuit having means to open and close the flue damper and means for determining if the flue damper is in the open position; and connecting means between the furnace control circuit and the flue damper circuit such that the configuration of the connecting means requires removal of the jumper conductor before the furnace control circuit is connected to the flue damper circuit, said jumper conductor removal requiring the means for determining if the flue damper is in the open position to determine that the flue damper is open prior to the heat source means being engaged by the sensing means whereby upon connection of the flue damper, the heat source means may not be engaged unless the flue damper is in the open position.

2. The invention as set forth in claim 1 wherein the appropriate connections of the furnace control circuit are a plurality of conductor runs located on a printed circuit board and wherein the jumper conductor is also a conductor run on the printed circuit board.

3. The invention as set forth in claim 2 wherein the means for determining if the flue damper is in the open position is a set of electrical contacts that are engaged when the damper is open.

4. The invention as set forth in claim 3 wherein the jumper conductor is located on a portion of the printed circuit board that is previously weakened to facilitate removal of the portion of the printed circuit board containing the jumper conductor.

5. The invention as set forth in claim 4 wherein the printed circuit board has the jumper conductor located at an edge thereof, said printed circuit board having slots therethrough on either side of the jumper conductor such that the jumper portion of the printed circuit board may be physically removed electrically disconnecting the heat source means from the sensing means.

6. The invention as set forth in claim 2 wherein the connecting means includes a connector engaged to the flue damper circuit, said connector being sized to electrically engage the conductor runs on the printed circuit board.

7. The invention as set forth in claim 6 wherein the conductor runs are located at the edge of the printed circuit board adjacent to the jumper portion of the printed circuit board, and wherein there is an opening in the printed circuit board adjacent to the runs on the opposite side of the conductor runs from the jumper portion such that when the jumper portion is removed the connector may slide over the conductor run portion of the printed circuit board connecting the damper circuit to the furnace control circuit, however prior to the jumper portion being removed there is insufficient clearance to attach the connector.

8. The invention as set forth in claim 6 and further including;

a first conductor run which is connected to a power source within the furnace control circuit to operate a motor to close the flue damper;

a second conductor run which is attached to a common wire in the furnace control circuit to complete the motor circuit;

a third conductor run attached to the sensing means for conducting a signal when heating is required; and a fourth conductor run attached to the heat source means to operate the furnace when the signal generated by the sensing means passes through the electrical contacts indicating the damper is in the open position.

9. The invention as set forth in claim 8 wherein the adapter comprises a body having an opening therein for receiving the conductor run portion of the printed circuit board and a plurality of spring contacts arranged so that each contact engages a conductor run forming an electrical connection, each contact also being connected to the appropriate element of the flue damper circuit.

10. A method for assuring that a retrofit flue damper to be added to a furnace having a sensing means for determining when heating is required and a heat source means for supplying heat, a flue damper having a flue damper circuit which prevents the heat source means from being energized if the flue damper is not in the open position, is properly installed which comprises the steps of:

providing a furnace control circuit connecting the heat source means to the sensing means, said circuit being adapted to receive a retrofit flue damper circuit; and preventing the electrical connection of the flue damper circuit to the furnace control circuit if the heat source means remains connected to the sensing means within the furnace control circuit.

11. The invention as set forth in claim 10 wherein the step of preventing includes:

forming a jumper conductor as part of the furnace control circuit connecting the heat source means to the sensing means; and attaching a connector to the flue damper circuit such that the connector may not be electrically connected to the furnace control circuit unless the jumper conductor is first removed, thereby disengaging the furnace control circuit connection of the heat source means to the sensing means.

* * * * *